US005582492A

United States Patent [19]

Doyle, Jr.

[11] Patent Number: 5,582,492

[45] Date of Patent: Dec. 10, 1996

[54] METHOD AND APPARATUS FOR AN ANCHORED EARTH RESTRAINING WALL

[76] Inventor: Henry G. Doyle, Jr., 11219 Inwood Rd., Dallas, Tex. 75229

[21] Appl. No.: 544,848

[22] Filed: Oct. 18, 1995

[51] Int. Cl.[6] ..... E02D 5/00; E02D 29/02

[52] U.S. Cl. ..... 405/262; 405/284; 405/287; 405/258

[58] Field of Search ..... 405/258, 262, 405/284, 285, 286, 287, 272

[56] References Cited

U.S. PATENT DOCUMENTS 1,165,194 12/1915 MacCaferri .
4,117,686 10/1978 Hilfiker ..... 405/284
4,394,924 7/1983 Zaccheroni ..... 220/19
4,448,571 5/1984 Eckels ..... 405/284
4,728,227 3/1988 Wilson et al. ..... 405/284
4,904,124 2/1990 Egan ..... 405/262
4,914,887 4/1990 Meheen ..... 52/565
4,952,098 8/1990 Grayson et al. ..... 405/262
4,993,879 2/1991 Hilfiker ..... 405/262
5,076,735 12/1991 Hilfiker ..... 405/284
5,161,917 11/1992 Papetti ..... 405/262 X
5,333,970 8/1994 Heselden ..... 405/286

*Primary Examiner*—Dennis L. Taylor
*Attorney, Agent, or Firm*—John F. Bryan

[57] ABSTRACT

In a wall for restraining earth from displacement relative to a stable formation, a plurality of side-by-side gabion baskets are joined by an integral structural beam and the beam is anchored at intervals with respect to the stable formation.

16 Claims, 6 Drawing Sheets

METHOD AND APPARATUS FOR AN ANCHORED EARTH RESTRAINING WALL

FIELD OF THE INVENTION

The present invention relates to anchored soil retaining and erosion control walls wherein open wire mesh baskets are filled with rocks and installed against a soil bank to prevent displacement thereof relative to an adjacent formation and, more particularly, to such walls wherein a plurality of wire mesh baskets are joined together as a unitary structure for anchoring to the adjacent formation.

BACKGROUND AND SUMMARY OF THE INVENTION

The need for soil retaining and erosion control structures must surely date back to the earliest stages of civilization. Man first sought camp sites along streams, rivers and shore lines and later settled in such areas, so that some of his earliest permanent structures were undoubtedly subject to soil instability problems. In all likelihood, the first soil retaining effort involved placement of irregular rocks as a protective blanket at some exposed location to discourage erosion. This evolved into the more formalized application of riprap well known in the art. Gabions, wherein relatively small rock pieces are packed into building block-like containers made of wire netting, are a variation which have been used in gravity wall and blanket type erosion control structures for many years.

Gabions have also come to be used for retaining walls. In a typical application, the soil bank to be protected is cut back to allow space for a wide based, upwardly tapering stack of tiers of gabions. Adjacent gabions are usually wired together to act as a continuous barrier and the gabions of alternating tiers may be staggered to promote an interlocking effect. Gabions have an economic advantage over precast or monolithic concrete construction in that heavy equipment and skilled labor are not essential to their installation. The rock pieces used to fill them may weigh no more than about 25 pounds apiece and are a relatively inexpensive material. Thus, the gabions, which are themselves lightweight, wire net structures in the form of cubes or rectangular prisms of up no three or four feet on a side, may be set in place and filled by hand or light machinery. Moreover, the open interstices of a gabion structure provide far better drainage than is possible with concrete or masonry construction, where French drain arrangements must usually be provided to avoid entrapment of water and potentially damaging hydraulic forces.

An engineering analysis identifies the essential design criteria of retaining structures as:

A. Adequate bearing support for the structure.

B. Resistance to overturning forces.

C. Resistance to sliding forces.

Contemporary retaining and erosion control structures, designed according to accepted practice, utilize interlocking, precast panels or monolithic systems, held in place by various methods. Gabion based structures of the prior art, which resist soil displacement and overturning forces by virtue of sheer mass and wide footprint, have been considered to be technically inferior to the structures of current design practice. As a result, gabion structures have mainly been used only in less demanding applications.

The object of the present invention is therefore, to provide gabion based retaining structures which are technically equal or superior to current design practice and furthermore, to achieve this improved structure while retaining the inherent advantages of gabions. A further object is to provide this improved structure at lower cost than for a comparable conventional gabion structure.

The present invention achieves this object by introducing a unitary beam into single row tiers of the gabion structure and anchoring this unitary beam so as to react the soil retention loads imposed on the gabion tiers into a stable adjacent formation or structure. The anchors balance the single row tiers against soil pressure so that a multiple row wide base is not required to resist overturning forces and great mass is not needed to resist sliding forces.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
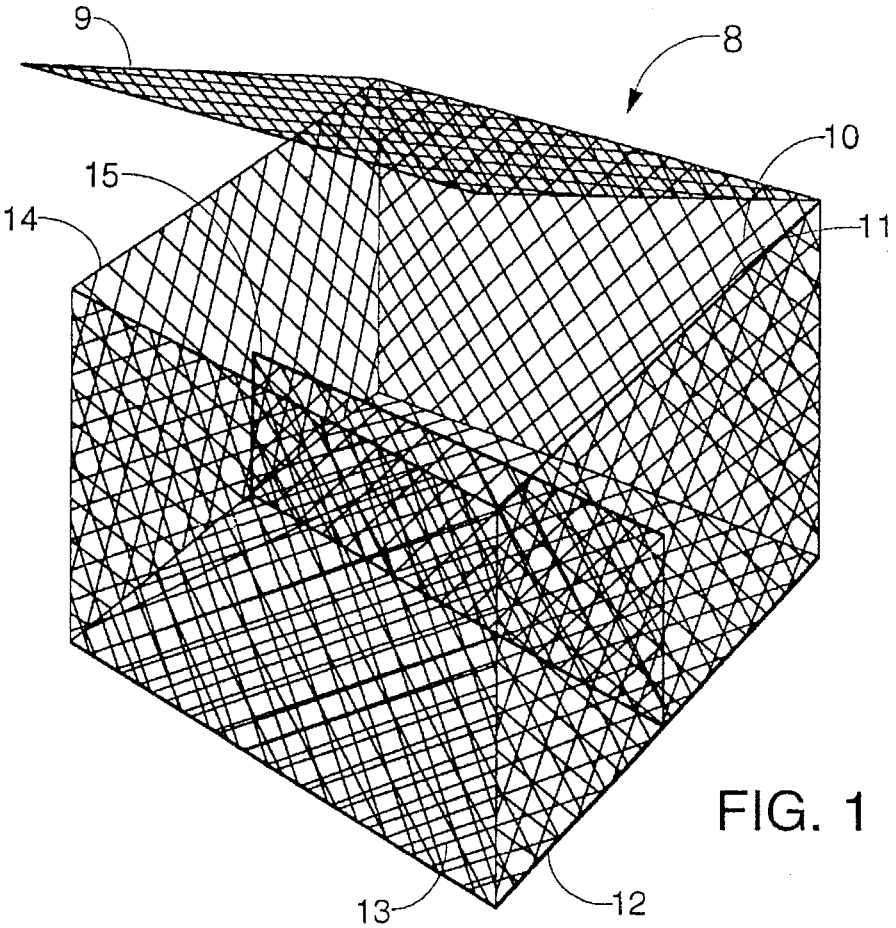
FIG. 1 shows the form of a typical gabion basket as used in the present invention.
Figure 1A:
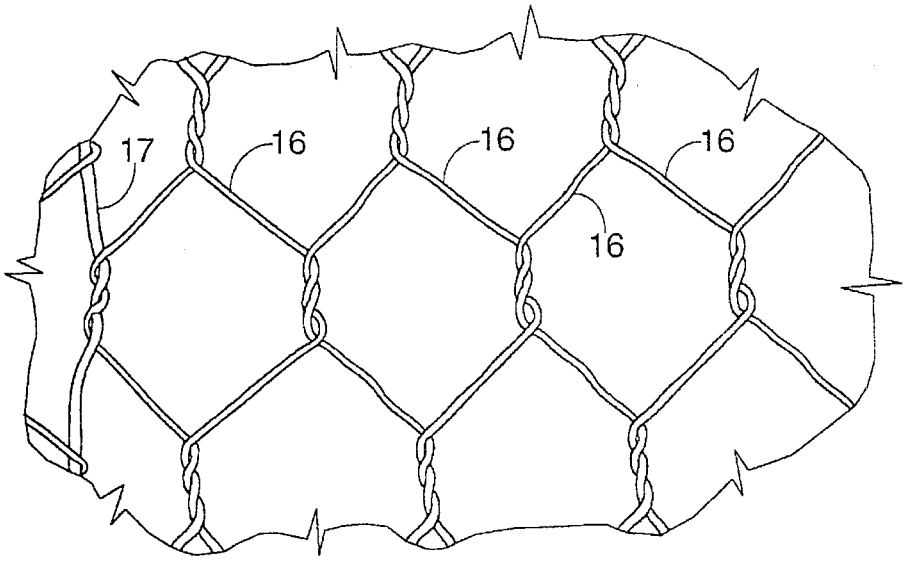
FIG. 1A shows the wire netting material used in making the gabion of FIG. 1.

The present invention employs gabions, which are essentially steel baskets, generally having six flat sides made of wire netting as shown in gabion assembly 8 of FIG. 1. Here, side panels 11 and 14, front panel 13 and rear panel 10 are joined together with bottom panel 12 to form an open topped basket. Top panel 9 is not closed until after the gabion is filled with rocks, when it is permanently wired or otherwise tied in place. The function of partition panel 15 will become clear as the present invention is described below. FIG. 1A shows the construction of a typical gabion panel wherein wires 16 are woven by twisting them together in a hexagonal netting pattern which is joined to heavier corner wires 17. The gabion panels may also be formed in welded wire mesh, or in any convenient and/or economical way. The invention does not reside in the construction of the gabions per se, but rather, in a unique assemblage and anchoring of a plurality of gabions.

Figure 2:
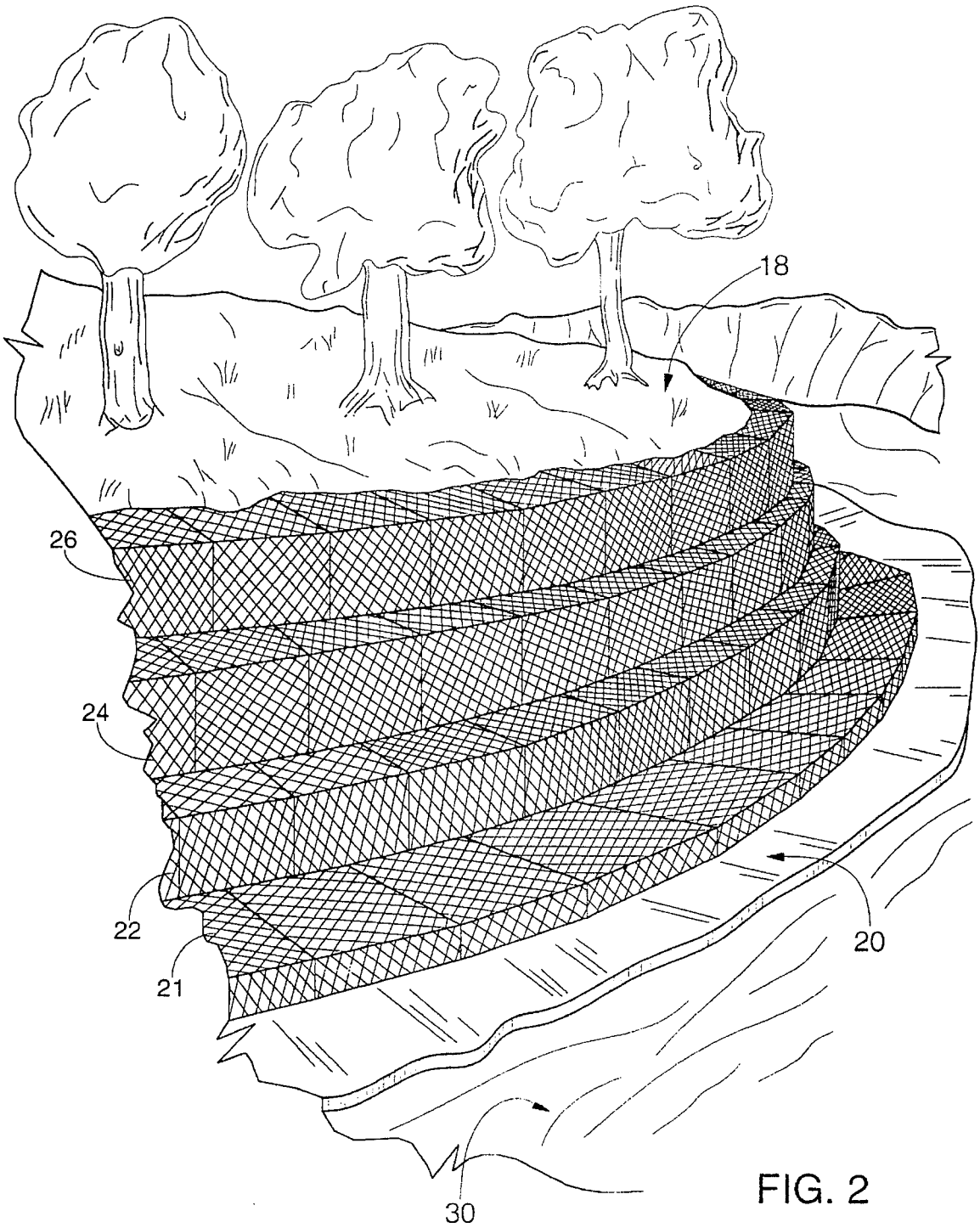
FIG. 2 shows a gabion structure in accordance with a preferred embodiment of the present invention.

In FIG. 2 is shown the arrangement of a typical gabion retaining wall 20 of the present invention, retaining earth bank 18, which in this example, is unstable because of erosion by stream 30. First, second and third gabion tiers 22, 24 and 26 are stacked respectively, to the height required for restraint of the unstable mass of earth bank 18, with tier 24 set back slightly from tier 22 and tier 26 set back, in a like manner, from tier The set-back arrangement is preferred for it brings both downward and horizontal components of the anchoring force into reaction against the retained earth. In another embodiment, the wall might also have batter, or backward tilt, against earth bank 18 for further resistance to overturning. Gabion mattress 21 is laid at or near the base of tier 22 to discourage further erosion at that critical point. The gabion sides in mattress 21 and in tiers 22, 24 and 26 are inclined as required to allow the individual gabions of the mattress and tiers to fit closely together in approximate alignment with inward or outward curvature of bank 18. In keeping with standard practice, the corners of each gabion are wired or otherwise attached to those of the adjacent cell.

Figure 3:
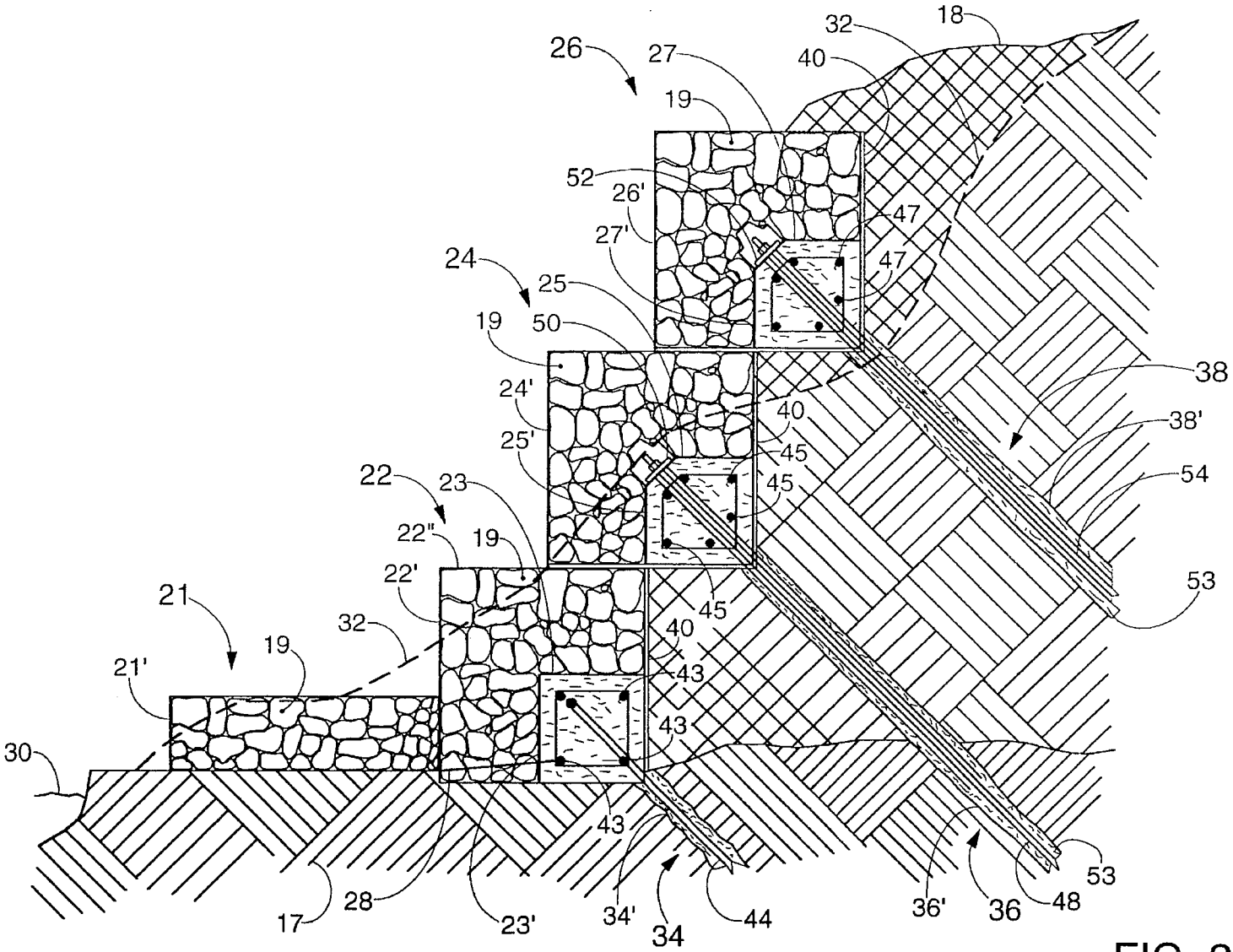
FIG. 3 shows a cross-sectional view of the anchored gabion structure of FIG. 2.

FIG. 3 shows a cross-section of the structure of retaining wall 20 of FIG. 2. In order to evaluate local conditions, a geotechnical soil survey is made, taking core drilled samples. These samples are analyzed and the results plotted so that the design loads for the retaining structure can be calculated. In a typical installation such as the retaining wall 20 of FIG. 2, the design load may be in the range of 30–80 lbs./ft$^3$. The design load is expressed in terms of pounds, per vertical square foot, per foot of depth, hence lbs./ft$^3$, and gives a quantitative basis for designing tier beams 23, 25 & 27 and tieback anchors 34, 36 & 38. Placement of the anchors along the tier beam length is established to make best use of the beam's flexural and shear strength, and may vary along the length of a tier while the beam section remains constant. In this preferred embodiment, the anchors are spaced at approximately 20' on centers, however, anchor spacing and beam design are interrelated so that the final configuration is up to the designer's choice. The installation of retaining wall 20 is begun by cutting away the existing bank 32 to allow placing open topped gabion baskets 22' on stable formation 17 and wiring adjacent comers together, so as to form tier 22. In this preferred embodiment, gabion basket 22' includes partition 23', provided for the purpose of forming tier beam 23, as will be described. In this preferred embodiment, tier 22 is backed by a highly permeable filter fabric 40, however, backfiil material can also be used to allow drainage through the wall without erosion. In this preferred embodiment, tiers 22, 24 and 26 are shown to have horizontal upper and lower surfaces and vertical front and rear surfaces but, it should be understood that these tiers may also be placed in batter, with front and rear faces sloping back and upwardly and the upper and lower surfaces consequently tilted. For the purposes of this disclosure, tier upper and lower surfaces shall be considered substantially horizontal in any case, and tier front and rear surfaces shall be considered substantially vertical.

With open topped gabion baskets 22' in place, anchor holes 34' for passive tieback anchor assemblies 34 are drilled into stable rock or soil formation 17, to a depth calculated to provide retention for the required restraining force. The expansive grout used to set the anchors in stable formation 17 provides retention for a restraining force in the range of 500–3,000 pounds per linear foot of engagement, depending upon local variables. Such holes may provide effective anchoring while inclined over a wide range of angles with respect to the horizontal, but standardizing on a given angle avoids potential confusion and set-up changes during field installation. The 45° angle of this preferred embodiment gives a good horizontal vector force component without the excessive anchor length that a flatter angle would entail. Anchor bar 44, with its outer end formed for retention in beam 23, is centrally positioned in hole 34' and longitudinal beam reinforcing bars 43, which are continuous through the sides of gabion baskets 22' and along the length of tier 22, are installed according to ACI 315 "Manual of Standard Practice for Detailing Concrete Structures" or a similar accepted standard code.

Hole 34' is filled with expansive grout and the portion of gabion baskets 22' outside of partitions 23' is filled with selected rock material 19 which is manipulated to eliminate voids insofar as possible. The bottoms of gabion baskets 22' are supported by the underlying formation and the backs by backfill against filter fabric 40. Partitions 23' are backed by rock material 19. Thus, a form is provided for pouring reinforced concrete beam 23 along the length of tier 22. After pouring beam 23, the filling of gabion baskets 22' with selected rock material 19 is completed, again manipulating the material to minimize void spaces. Any rock-like material, ore, slag or broken concrete may be used for economy but, pieces selected for cosmetic appearance should be used where exposed to view, and the pieces should be manipulated to minimize void spaces. When gabions 22' are filled, basket tops 22" are wired into place and tier 22 is complete.

The construction of retaining wall 20 is continued by benching as required into existing bank 32 for placement of open topped gabion baskets 24' to form tier 24. As with tier 22, adjacent baskets 24' are wired together to form tier 24. Tier 24 is backed by filter fabric 40 and select backfill material to allow drainage through the wall without erosion. With gabion baskets 24' in place, anchor holes 36' for active tieback anchor assemblies 36 are drilled through the bank material into stable formation 17 although, depending upon conditions, it may not be necessary to anchor every tier. Anchor holes 34' are drilled to a depth calculated to provide the horizontal restraining force component required to hold the soil bank in equilibrium. Active anchor bars 48 with the outer portion of their length protected as is discussed below, are placed full depth and centrally positioned in holes 36'. Longitudinal beam reinforcing bars 45, continuous through the sides of gabion baskets 24', and along the length of tier 24, are installed according to standard practice. Holes 36' are filled with expansive grout 53 and the portion of gabion baskets 24' outside of partitions 25' is filled with selected rock material 19. The bottoms and backs of gabion baskets 24' are supported by backfill against filter fabric 40. Partitions 25' are backed by rock material 19 and plates 50 are fitted around anchor bars 48 to provide seating surfaces for tensioning forces. Thus, a form is provided for pouring reinforced concrete beam 25 along the length of tier 24. After tier beam 25 has been formed and cured, active anchor assemblies 36 are tensioned. The filling of gabion baskets 24' with selected rock material 19 is then completed and basket tops 24" are wired into place to close gabions 24' and complete tier 24.

After filling or benching as required, open topped gabion baskets 26' are placed side-by-side and wired together, as with tiers 22 and 24, to form tier 26. As previously, tier 26 is backed by filter fabric 40 and select backfill material to allow drainage. With gabion baskets 26' in place, anchor holes 38' for active tieback anchor assemblies 38 are drilled through the bank material into stable formation 17 to a depth calculated to provide retention for the horizontal restraining force component required to maintain the soil bank in equilibrium. Active anchor bars 54, with the outer portion of their length protected as is later discussed, are placed full depth and centrally positioned in holes 38'. Longitudinal beam reinforcing bars 47, continuous through the sides of gabion baskets 26' and along the length of tier 26, are installed according to standard practice. Holes 38' are filled with expansive grout 53 and the portion of gabion baskets 26' outside of partitions 27' is filled with selected rock material 19. The bottoms and backs of gabion baskets 26' are supported by backfill against filter fabric 40. Partitions 27' are backed by rock material 19 and plates 52 are fitted around anchor bars 54 to provide seating surfaces for tensioning forces. Thus, a form is provided for pouring reinforced concrete beam 27 along the length of tier 26. After beam 27 has been formed and cured, active anchor assemblies 38 are tensioned. The filling of gabion baskets 26' with selected rock material 19 is then completed, and basket tops 26" are wired into place to close gabions 26'.

Gabion blanket 21 may be built at this time. Gabion blanket 21 comprises gabions 21' placed side-by-side, wired together, and tied back by wires 28 to the base corner of tier beam 23. Gabions 21' are filled with selected rock material 19, covered and wired shut. Backfilling and compacting stabilized bank 18 completes retaining wall 20.

Figure 4:
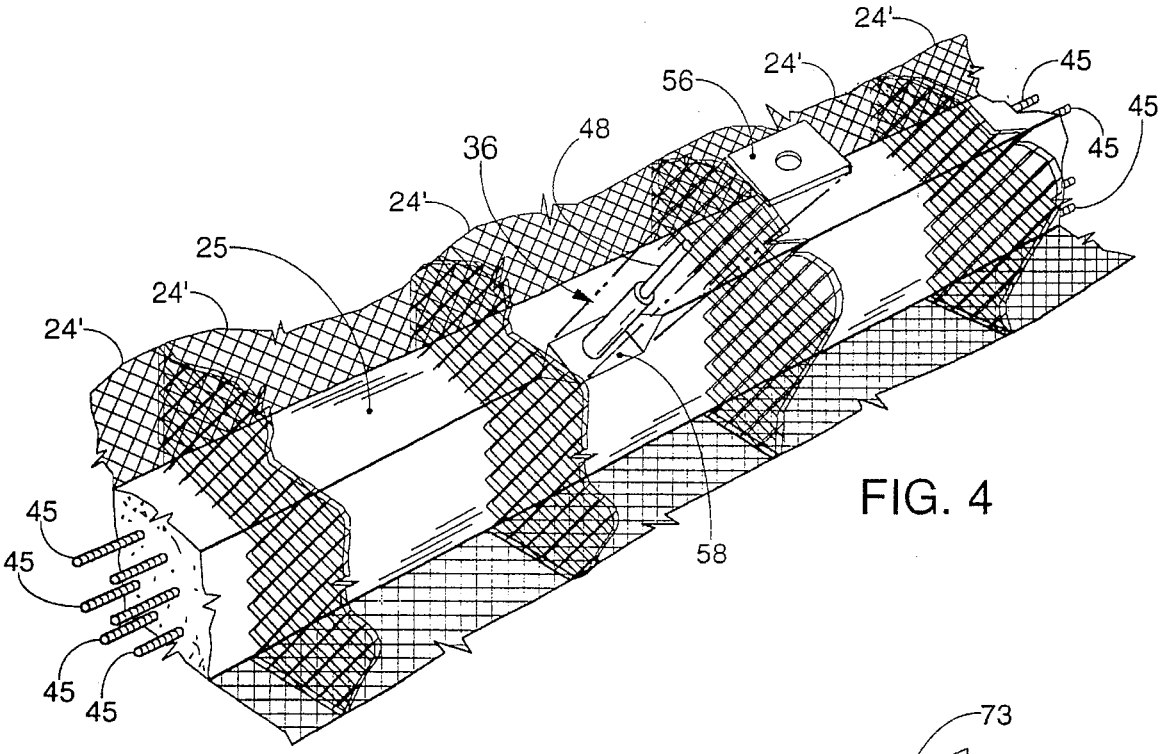
FIG. 4 is a broken-out view of a preferred embodiment of the structural beam of the gabion structure of FIG. 2.

FIG. 4 shows a broken out view of a typical portion of the length of reinforced concrete beam 25 of tier 26 as it might appear during construction. The partitions 25' which assist in forming the vertical outward surface of beam 25 are deleted from this view for clarity, while the other contacting panels of gabions 24' are shown in place. Here it is seen how the reinforcing bars 45 pass through the side panels of adjacent gabions 24' to provide continuous reinforcement in beam 25. Temporary form board 56 is fitted over anchor assembly 36 to form local flat surface 58 where plates 52 are later installed for tensioning of anchor bar 48. Anchor assembly is seen to be approximately normal to the length of beam 25 and may be angled slightly without adverse effect.

Figure 5A:
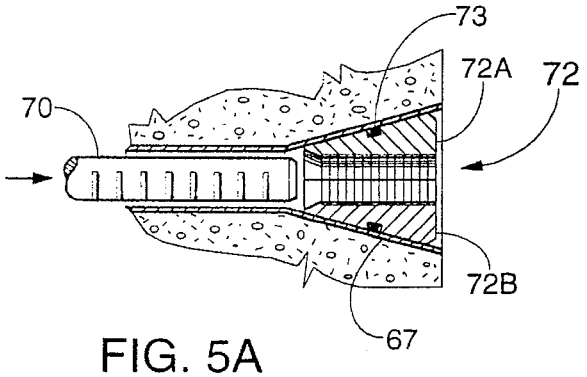
FIG. 5A is a partial view showing the tension bar keeper.
Figure 5:
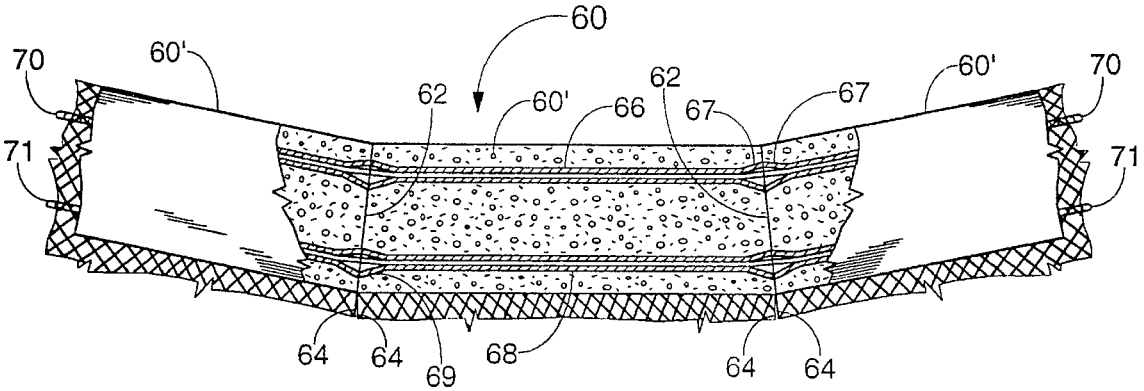
FIG. 5 is a view of an alternate embodiment of the structural beam of FIG. 4.
Figure 6:
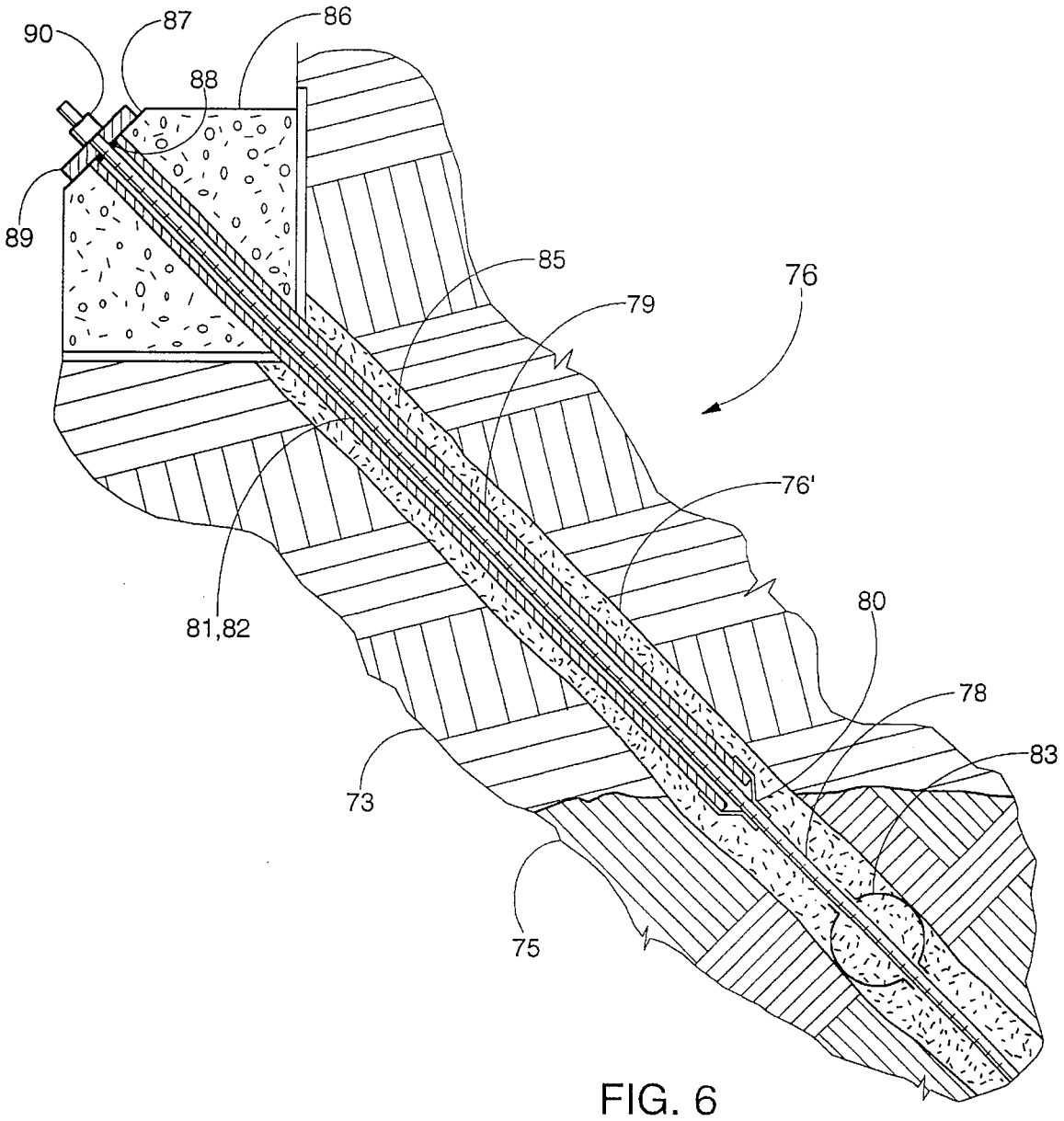
FIG. 6 shows a section view detail of a typical active tie-back anchor assembly.

FIG. 5 shows a precast, post-tensioned concrete beam 60 as an alternative to the poured-in-place beam 25 of FIG. 6. Beam segments 60' are precision formed with ends 62 angled to provide a predetermined radius of curvature when assembled in a tier. Gabions 64 have side-walls angled in a similar manner and fitted to receive the length of beam segment 60'. Tension bar conduit lengths, which may be of PVC or similar material, are placed in segments 60' when cast, either as straight sections 66 or curved sections 68. Straight sections 66 join into flared transition pieces 67 to interface with ends 62 while curved sections join into flared transition pieces 69. The flared transition pieces 67 or 69 make it easier to thread post-tensioning bars 70 and 71 through a plurality of segments 60' and the intervening double side wall panels of gabions 64. The use of curved sections 68 is only desirable on short radius curvatures in order to reduce local bending forces and frictional drag on the post-tensioning bars. Otherwise, the straight sections 66 are satisfactory and more economical. Once in place, tension load is applied to post-tensioning bars 70 and 71 in a conventional manner, and maintained as shown in FIG. 5A. As is seen here, split nut tension bar keeper assembly 72, comprising identical halves 72A and 72B, engages the surface deformations of post-tensioning bar 70 and seats in the tapered throat of transition piece 67. The inward pressure of spring 73 around the circumference of keeper assembly 72 provides positive engagement of post-tension bar 70 for "blind" assembly.

FIG. 6 shows a detailed section view of active anchor assembly 76 which is representative of anchor assemblies 36 and 38 of FIG. 3. Active anchor assembly 76 is set in anchor hole 76', a hole of suitable chosen diameter, which may be about 4", drilled through the soil bank 73 into stable formation 75. Anchor hole 76' is drilled to the calculated depth and anchor bar 78 is prepared for post tensioning by cleaning the portion of its length which engages formation 75 in preparation for grouting. The portion of the length of anchor bar 78 not engaging formation 75 is jacketed in tube 79, made of PVC pipe or similar material in this embodiment. The opening between the lower end of tube 79 and anchor 78 is sealed with tape 80 and annulus 81 is filled with lithium based grease 82. Centralizers 83, which are commercially available, or may be shop made, allow passage of grout and are spaced along the formation engaging portion of anchor 78, keeping it from contacting formation 75 while hole 76' is filled with grout 85. Grouting is accomplished by means of a tubular tool inserted to the hole bottom so as to avoid entrapment of air. Tube 79 is trimmed flush with flat seating area 87 on reinforced concrete beam 86 and resilient seal 88 is pressed into annulus 81 to retain grease 82. After grout 85 is cured, anchor bar 78 is tensioned to provide the horizontal force required to balance soil pressure and nut 90 engages anchor bar 78 to maintain this force against plate 89.

Figure 7:
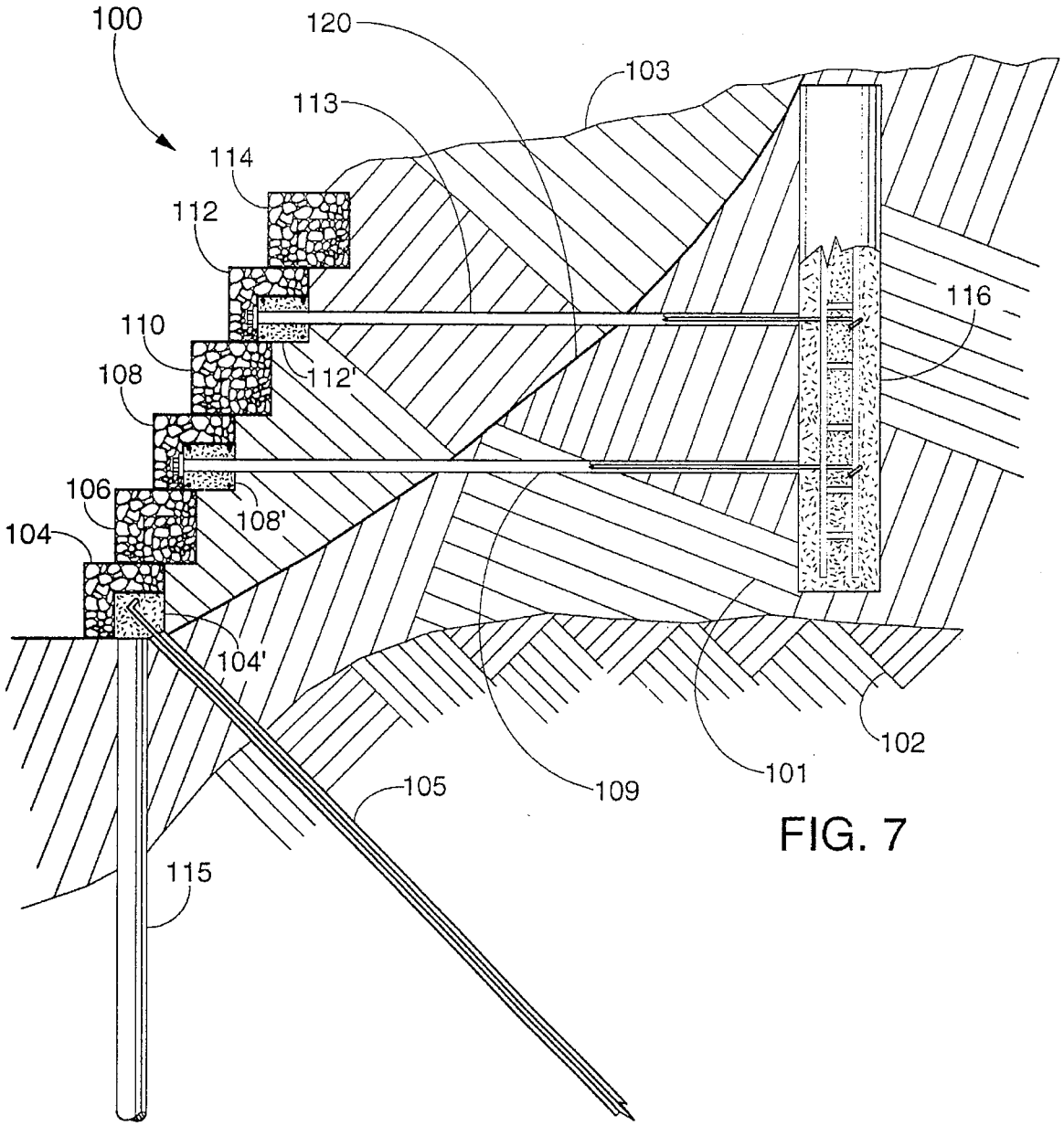
FIG. 7 shows a section view of an alternative embodiment of the present invention.

FIG. 7 shows an alternate preferred embodiment in earth restraining wall 100, which is suitable for installation where underlying formation 102 does not afford reliable anchor retention at feasible drilling depths. Unstable soil mass 103 tends to movement relative to stable soil mass 101 along slip plane 120 and is restrained from doing so by gabion tiers 104, 106, 108, 110, 112 & 114. Should underlying formation 102 not have sufficient compressive strength for support of lowermost tier 104 in bearing, piers 115 are provided in the conventional manner for this purpose. Lowermost tier 104 is anchored by tier beam 104' and passive anchors 105 spaced at intervals along its length. In the case of lowermost tier 104, anchor holes can possibly be drilled deeply enough into underlying formation 102 to develop sufficient anchoring force. When such depth is not practical for the higher tiers, stable soil mass 101 becomes an alternative anchoring formation. Second, fourth and top tiers 106, 110 and 114 are gabion baskets, joined together as previously discussed, but are not anchored in this example and thus, do not require a tier beam. Intermediate tiers 108 and 112 have tier beams 108' and 112' for the attachment of active anchor assemblies 109 and 113. Anchor 109, which is generally parallel to, but may be out-of-plane with respect to anchor 113, runs horizontally to connect into deadman 116. Similarly, anchor 113 runs horizontally from tier beam 112' to connect into deadman 116, which may be a vertical, reinforced concrete pier as shown, or some other, similar stable structure. In any case, deadman 116 is of sufficient size to afford bearing support for holding against anchors 109 and 113 in stable soil mass 101. These active anchors are tensioned after installation to provide sufficient restraining force to prevent movement of unstable soil mass along slip plane 120. Inasmuch as the same "deadman method" may be also used for anchoring tier 104 if necessary, earth restraining wall 100 need not depend upon underlying formation 102 in any way. Construction of the gabion tiers is otherwise the same as described for previous embodiments.

It is to be understood that the present invention is not limited to the disclosed embodiments and may be expressed by rearrangement or modification or substitution of parts within the spirit of the invention.

I claim:

1. A wall for restraining earth from displacement relative to a stable formation comprising:

a plurality of gabions arranged in a side-to-side relationship so as to form a length of wall proximate the earth to be restrained, said gabions and wall having substantially vertical inner and outer surfaces and substantially horizontal upper and lower surfaces;

bearing means for support of said length of wall with respect to said stable foundation beam means longitudinal to said wall, within the surfaces thereof, for joining a plurality of said gabions as a unitary structure;

rock-like pieces filling said gabions; and means for anchoring said beam means, including means for retention of said anchoring means relative to said stable formation so as to restrain earth from movement with respect thereto.

2. A wall for restraining earth from displacement according to claim 1 wherein the sides of said gabions are inclined so as to allow said wall to conform to a curved path.

3. A wall for restraining earth from displacement according to claim 1 wherein said beam means further comprises:

a concrete beam; and a reinforcing bar longitudinally disposed within said beam and passing through the sides of said gabions.

4. A wall for restraining earth from displacement according to claim 1 wherein said beam means further comprises a concrete beam which is cast-in-place.

5. A wall for restraining earth from displacement according to claim 1 and further comprising:

a substantially vertical partition of wire mesh within said gabions positioned from side to side within said gabions so as to restrain said stones from occupying a portion of the gabion interior; and said beam means further comprising a cast-in-place beam poured against said stones.

6. A wall for restraining earth from displacement according to claim 1 wherein said beam means further comprises a precast concrete beam.

7. A wall for restraining earth from displacement according to claim 1 wherein said beam anchoring means further comprises a bar having an axis approximately normal to the length of said beam means and extending therefrom to said retention means.

8. A wall for restraining earth from displacement according to claim 1 wherein said beam anchoring means further comprises a tensioned bar extending from said beam means to said retention means.

9. A wall for restraining earth from displacement according to claim 1 wherein said anchoring means further comprises:

a tension bar connected to said beam means;

a hole provided in said stable formation and engaging said tension bar through a predetermined length thereof; and grouting means for retention of said tension bar in said stable formation.

10. A wall for restraining earth from displacement according to claim 1 wherein said anchoring means further comprises:

a tension bar connected to said beam means;

a stable structure placed so as to provide bearing support with respect to said stable formation; and connecting means for retention of said tension bar in said deadman.

11. A wall for restraining earth from displacement according to claim 1 wherein said bearing means comprises support for said length of wall as provided by said stable formation.

12. A wall for restraining earth from displacement according to claim 1 wherein said bearing means comprises piers placed to support said length of wall with respect to said stable formation.

13. A wall for restraining earth from displacement according to claim 3 wherein said beam means further comprises a cast-in-place concrete beam.

14. A wall for restraining earth from displacement according to claim 3 wherein said beam means further comprises a precast concrete beam.

15. A method for restraining earth from displacement relative to a stable formation comprising the steps of:

excavating a bench at the toe line of the unstable earthen mass;

providing a plurality of gabions;

providing bearing support for said gabions along the excavated bench;

arranging the gabions side-by-side along the excavated bench;

placing a bee within the gabions so as to join the gabions together in a structural unit;

anchoring the beam with respect to the stable formation; and filling the gabions with pieces of rock-like material.

16. The method of claim 15 wherein the step of anchoring the beam is repeated at a plurality of locations along the length of the beam.

* * * * *

UNITED STATES PATENT AND TRADEMARK OFFICE

CERTIFICATE OF CORRECTION

PATENT NO. : 5,582,492
DATED : December 10, 1996
INVENTOR(S) : Henry G. Doyle, Jr., et al It is certified that error appears in the above-indentified patent and that said Letters Patent is hereby corrected as shown below:

On the title page item [76], add the following inventors:

Glen W. Campbell
2933 Sinbad Circle
Farmers Branch, TX 75234

F. Whitney Smith
500 Woodlake Drive
Coppell, TX 75019

Craig Olden
460 East Shahan's Road
Little Elm, TX 75068

Signed and Sealed this
Eighth Day of April, 1997

*Attest:*

*Attesting Officer*

BRUCE LEHMAN

*Commissioner of Patents and Trademarks*